United States Patent [19]

Hoffman

[11] 4,431,303

[45] Feb. 14, 1984

[54] SHEET HANDLING APPARATUS FOR USE WITH A VERY HIGH SPEED DUPLICATOR

[75] Inventor: Daniel S. Hoffman, Rochester, N.Y.

[73] Assignee: Xerox Corporation, Stamford, Conn.

[21] Appl. No.: 318,096

[22] Filed: Nov. 4, 1981

[51] Int. Cl.[3] ..... G03G 15/00

[52] U.S. Cl. ..... 355/3 SH; 355/3 TR; 355/24; 355/26; 271/186; 271/DIG. 9

[58] Field of Search ..... 355/23, 24, 26, 3 SH, 355/14 SH, 3 TR, 3 R; 271/65, 186, DIG. 9, 277, 82; 101/230, 231

[56] References Cited

U.S. PATENT DOCUMENTS

| | | | |
|---|---|---|---|
| 3,672,765 | 6/1972 | Altmann | 355/24 |
| 3,856,295 | 12/1974 | Looney | 271/65 |
| 3,862,802 | 1/1975 | Till | 355/23 |
| 3,942,785 | 3/1976 | Stange | 271/DIG. 9 |
| 4,035,073 | 7/1977 | Del Vecchio | 355/24 |
| 4,040,616 | 8/1977 | Clarkson et al. | 271/186 X |
| 4,066,252 | 1/1978 | Wick | 271/DIG. 9 |
| 4,072,412 | 2/1978 | Suda et al. | 355/3 TR |
| 4,174,905 | 11/1979 | DiFrancesco et al. | 355/14 R |
| 4,186,662 | 2/1980 | Borneman | 271/DIG. 9 |
| 4,191,465 | 3/1980 | Boase et al. | 271/186 X |
| 4,214,831 | 7/1980 | Reesen | 355/24 X |
| 4,241,658 | 12/1980 | Ricciardi | 101/231 |
| 4,272,181 | 6/1981 | Treseder | 271/186 X |

OTHER PUBLICATIONS

Research Disclosure Bulletin, Sep. 1979, pp. 501, 502; Item 18553.

*Primary Examiner*—Richard L. Moses

*Attorney, Agent, or Firm*—Bernard A. Chiama

[57] ABSTRACT

A copy sheet handling arrangement for use in a copying machine for producing duplex copies during a single pass through the processor of the machine. A transfer roller having a lead edge gripping device directs the sheet through the transfer station to receive a first toner image on one side. Reversing transport mechanism returns the sheet to the roller whereat the trailing edge is gripped and the sheet is returned to the transfer station in an inverted orientation to receive a second toner image on the other side thereof.

5 Claims, 6 Drawing Figures

11
12
14
15
18
19
24
25
26
27
28
29
30
31
32
33
34
35
36
37
39
40
50
51
65
74
D
P

SHEET HANDLING APPARATUS FOR USE WITH A VERY HIGH SPEED DUPLICATOR

This invention relates to an improved reproduction system having an improved copy sheet handling apparatus for use in such system to provide single pass duplexing capability.

With the advent of higher speed and more sophisticated copying machines, considerations as to how the mass of copy sheets generated can best and more effectively be handled within the machine has assumed increasing importance. Particularly important is the handling of copy sheets during duplex copying either from simplex or duplex document sheets. One way has been to provide a reproduction system having an inut device in the form of an automatic document handling apparatus with an auxiliary paper tray arranged to collect copy sheets having a first side image transferred thereto and then to feed back these sheets for collecting a second side image.

Another arrangement would utilize a recirculating document handling apparatus which provides for exposure of document sheets, one at a time, in precollated fashion. In these systems, for duplex copying, a sheet inverter and attendant sheet transport devices are arranged so that after an image is transferred to one side of a sheet, the same is turned over and returned to the transfer station to receive an image on the backside of the sheet. In either of these arrangements, elaborate sheet transport devices, skewers, sheet registration means and other accessory equipment must be utilized in order to handle sheets in proper registration at the proper time, in proper orientation, all at high speed.

Other disadvantages are readily apparent when one considers the relatively long paths to which sheets must be subjected during operation of these known duplex copying machines. Costly sheet transport devices must be employed along the entire sheet path to insure firm and jam-free transporting.

Therefore, it is the principle object of this invention to enable duplex copying utilizing minimum sheet handling equipment and movement.

Another object of the present invention is to copy on both sides of sheets of paper during a single pass of the sheets through a copier.

Still another object of the invention is to minimize the possibilities for jams and machine malfunctions during duplex copying.

These and other objects of the invention are accomplished by utilizing a transfer roller at the transfer station of a xerographic copier for applying only one side of each sheet to a photoreceptor during simplex copying and for applying both sides in succession during duplex copying. An integrated transport system is arranged downstream of the transfer station for directing sheets toward and away from this station.

Figure 1:
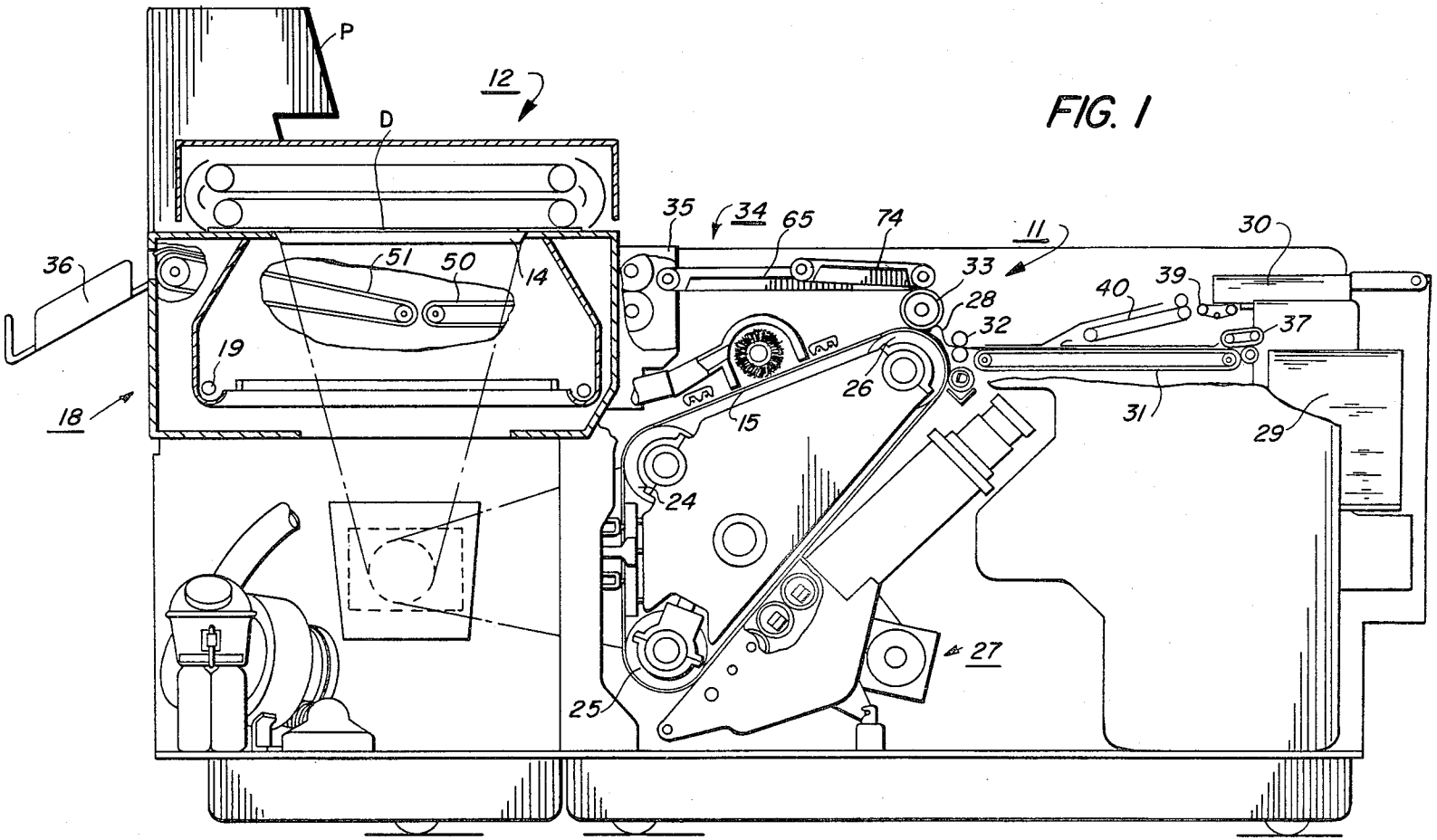

Other objects and advantages will become apparent from the following description taken in conjunction with the accompanying drawings wherein:

FIG. 1 is a schematic representation of an exemplary reproduction system incorporating the document handling apparatus of the present invention; and FIGS. 2–6 are partial, schematic views showing details of the sheet handling apparatus for the system of FIG. 1 in various phases of operation.

For a general understanding of a reproduction machine with which the present invention may be incorporated, reference is made to FIG. 1 wherein components of a typical electrostatic printing system are illustrated. The printing system is preferably of the xerographic type as one including a xerographic processor 11, and a document handling apparatus 12. Preferably the processor 11 is the same as the processor in the commercial embodiment of the Xerox duplicator model 9200 which utilizes flash, full frame exposure, for very high speed production. The document handling apparatus 12 may be of any suitable type which is adapted to take document sheets in collated or numerical sequence and to feed both sides of each sheet upon the exposure platen for the processor 11.

The xerographic processor 11 is arranged as a self-contained unit having all of its processing stations located in a unitary enclosure or cabinet. The processor includes an exposure station at which an original to be reproduced is positioned on a glass exposure platen 14 for projection onto a photosensitive surface in the form of a xerographic belt 15. The original or set of individual document sheets are selectively transported by the document feed apparatus 12 one document sheet at a time to the platen 14 for exposure. After an exposure of each document sheet is made, the same is turned over for exposure on the back side and/or returned to the top of the set until the entire set has been copied, whereupon the procedure starts again with a preset number of copy sets have been produced.

Imaging light rays from each of the document sheets, which are flash illuminated by an illumination system 18 having lamps 19 connected to a suitable flashing circuit (not shown) under control by the programmer P in timed sequence, and in accordance with the program the operator has preset in the machine. Further details in this regard are not necessary since the Xerox 9200 reproduction machine operates in this manner and is well known. The xerographic belt 15 is mounted for movement around three parallel arranged rollers 24, 25, 26 suitably mounted in the processor 11. The belt is continuously driven by a suitable motor (not shown) and at an appropriate speed. The exposure of the belt to the imaging light rays from a document discharges the photoconductive layer in the area struck by light whereby there remains on the belt an electrostatic latent image corresponding to the light image projected from the document. As the belt continues its movement, the electrostatic latent image passes a developing station at which there is positioned a developer apparatus 27 for developing the electrostatic latent image.

After development, the powdered image is moved to an image transfer station 28 where the developed image is transferred to a support surface, normally a sheet of copy paper, brought from a main or auxiliary paper tray 29, 30, respectively, as will appear. Each sheet is conveyed to the transfer station by a conveyor 31 which cooperates with sheet preregistration pinch rollers 32. These rollers are in driving contact to produce a nip whereat each sheet is preregistered prior to reaching the transfer station 28. Further details of the timing relationships and related structure and events are described in U.S. Pat. Nos. 3,790,270; 3,796,486; and 3,917,396, commonly assigned.

The sheet is moved in synchronism with the movement of the belt 15, and passes between a transfer roller 33 and the belt 15 at the transfer station. After transfer, the sheet of paper is stripped off the belt 15 and transported by one or more perforated belts 34, vacuum conveyor 35 in an inverted condition to a fusing station where a fuser device 36 is positioned to receive the sheet of paper for fusing the powder thereon. After fusing, the sheet is transported directly to an output compiler tray 37. A finishing apparatus, not shown, may replace the tray 37 in the event stapling or stitching is provided on the system.

The system comprising the processor 11 and the document handling apparatus 12 is under control of the programmer P which permits an operator various options: to turn the entire system ON or OFF; to program the reproduction system for a desired number of reproductions to be made of each original document sheet or set; to select whether simplex or duplex copies are to be made and whether from simplex or duplex originals; to select a desired output arrangement, that is, sets mode or stacks mode, stapled or unstapled; to select one of a plurality of paper trays; to condition the machine for the type of document, that is, whether one sided or two sided, to select a copy size reduction mode, and other desirable functions. The programmer P also includes a controller which provides all operational timing and synchronization between the process 11 and all of its xerographic processing functions, and system control functions, the automatic events to be described hereinafter. The controller may include any suitable microprocessor having a CPU and the appropriate machine clock, but preferably the processor is one similar to the Intel 8080 microprocessor manufactured by the Intel Corporation, Santa Clara, California, and having sufficient ROM's and RAM's for all of the necessary functions in the reproduction system.

As previously stated, copy sheets are supplied from either the main paper tray 29 or the auxiliary paper tray 30. Main paper tray 29 may include a suitable elevator type base on which a supply of sheets rest, the base being supported for automatic up and down movement by suitable means (not shown). Such movement being arranged to maintain a top-feeding sheet feed mechanism 38 in operative contact with the topmost one of the sheets on a stack arranged on a suitable elevator. The sheet feed 38 is operated intermittently in timed relationship to spacing of images on the photoreceptor belt 15 under control of the programmer P, and serves to advance the topmost sheet from the supply stack 29 to the main paper supply transport 31.

The auxiliary tray 30, in the exemplary arrangement shown, is arranged above main tray 29 and includes an air floatation baseplate upon which a supply of sheets may be placed. A bottom-feeding, sheet feed mechanism 39 is positioned for feeding sheets from the bottom of the stack of sheets thereon. Assisting in this feeding operation is an air floatation system, not shown, which substantially reduces the weight of the stack to permit easy withdrawal of sheets from the bottom. The sheet feed mechanism 39 which is intermittently driven in the same manner as the main tray feed mechanism 38, advances one sheet at a time to an auxiliary paper supply transport 40. The transport 40 is suitably driven by a drive system (not shown) and is disposed to discharge sheets drawn from auxiliary tray 30 onto the operating run of main supply transport 31. The sheets from auxiliary tray 30 are thereafter directed to the preregistration rollers 32.

During operation, if the reproduction system is preset for simplex copying, copy sheets leaving the processor 11 after exiting the transfer station 28, are conveyed directly to the fuser apparatus 36 and to the output tray 37 by way of transports 50, 51.

The present invention is applicable to the duplex mode of copying wherein copy sheets receive images on both sides from document sheets having images on either one side or on both sides. The invention is adapted for cooperation with a document handling apparatus of the recirculating type, that is, one which is capable of handling either simplex or duplex document sheets and wherein document sheets are placed in numerical sequence and exposed in successive order. For duplex document sheets, exposure occurs first for one side of a sheet and then the other side, and so on in order to produce on a photoreceptor successive images corresponding to the pages of a document in numerical sequence either in increasing or decreasing order. For simplex document sheets, exposure occurs once for each sheet for the side bearing an image. To achieve single pass duplex, developed images are transferred to both sides of a copy sheet of paper upon passage of the sheet once through the processor 11. To this end, the transfer roller 33 is devised so that a sheet of paper may be gripped and held thereon for the transfer of a first image on one side of the sheet and to receive the sheet a second time, in an inverted orientation for the transfer of a second image on the other side of the sheet.

Figure 2:
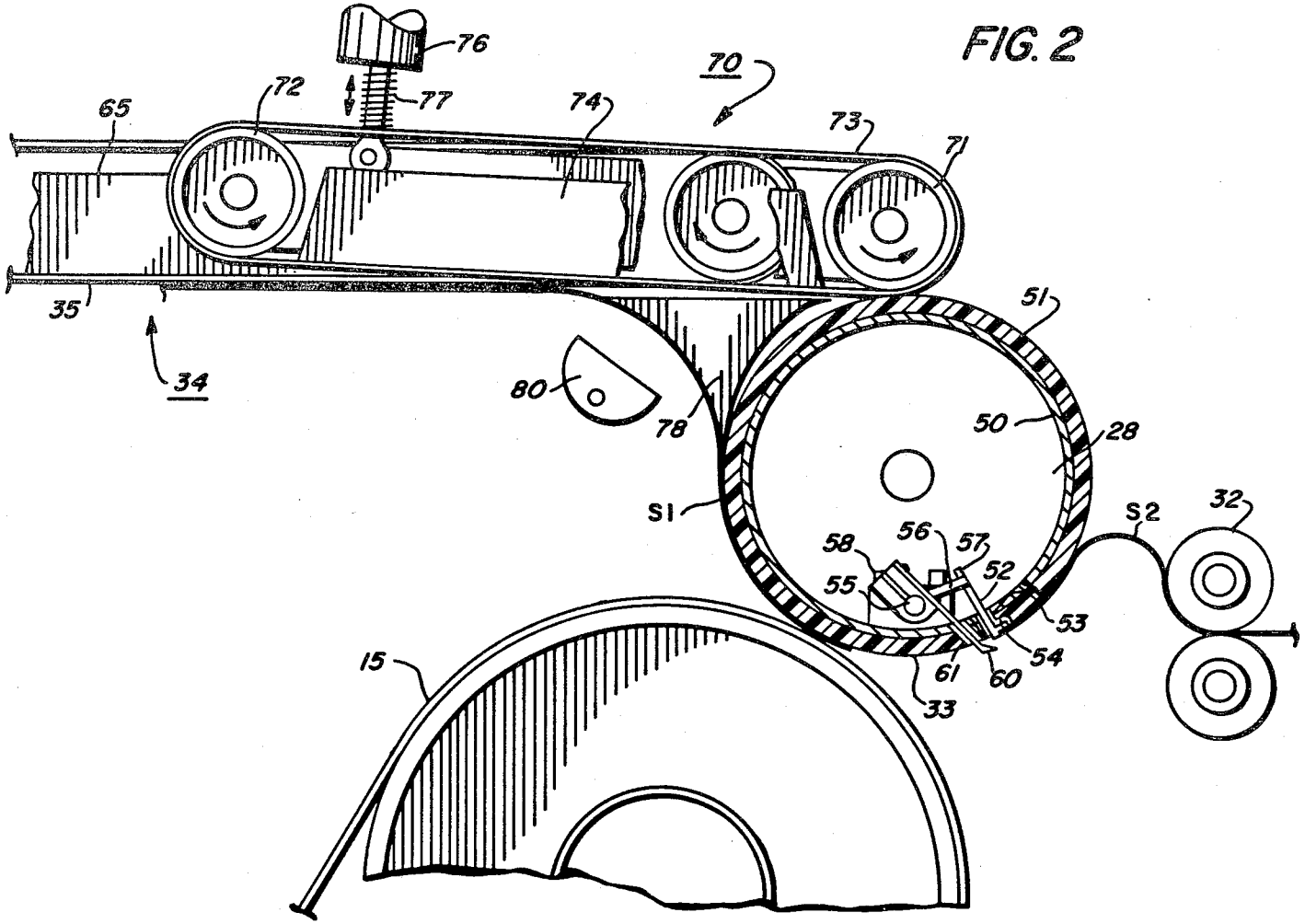

As shown in FIG. 2, the transfer roller 33 is in the form of a hollow drum and comprises a metal cylinder 50 having a rubber coating blanket 51 applied thereto. The blanket 51 is preferably made of a rubber compound having a resiliency such that with light pressure being applied thereto while in contact with the belt 15 and against the belt support roller 26, there will be a very light flattening for indentation into the blanket for enhancing image transfer. The roller 33 is connected to an electrical potential biasing circuit (not shown) to receive a transfer charging current during image transfer in the conventional manner.

The transfer roller 33, in serving as an image transfer arrangement, is capable of registering and supporting a sheet of paper for either one transfer cycle for the simplex mode of copying or for two transfer cycles relative to the same sheet for the duplex mode of copying. To effect precise registration and positioning of sheets of paper upon the roller 33, there is provided a plurality of registration elements 52 mounted within and for movement radially of the roller. The elements 52 extend through openings 53 formed in the periphery of the drum surface, the openings being in a line parallel to the axis of the roller.

Each of the elements 52 has a flat rectangular configuration and is formed with an outwardly extending projection 54 which is movable radially with the elements from a position within the periphery surface of the roller to two positions slightly outwardly of the periphery of the roller. When in use, the leading edge of a sheet S engages the elements 52 immediately outwardly of the projections 54 upon which the edge will be held during handling of the sheet.

Radial movement of the elements 52 is provided by means for shaft 55 mounted for rotation within the drum working in conjunction with drive rods 56 secured to the shaft and which are adapted to be slidably held within apertures 57 formed at the innermost ends of the elements 52. The shaft 55 is supported and journaled upon the inner surface of the cylinder 50 by means of bearing blocks 58, and upon rotation of the shaft, the rods 56 will be swung therewith for causing the registration elements 52 to move outwardly or inwardly as the case may be, relative to the axis of the roller 33. In operation, the elements 52 are adapted to assume three positions: the first, when no sheet is being transported, the elements occupy their innermost position, the second, in a slightly outward position so that the projections 54 are positioned slightly away from the peripheral surface of the roller when a sheet has been registered as shown in FIG. 2, and third, with the porjections 54 at a slightly greater distance from the periphery so as to move the leading edge of the sheet away from the roller surface to permit sheet stripout.

Operating in close conjunction with the registration elements 52 are a plurality of gripper fingers 60 which are secured to the shaft 55 by means of suitable fasteners and which extend through openings 61 formed in the periphery of the roller 33 adjacent the openings for the elements 52. The gripper fingers 60 are utilized to grip the leading edge of a sheet of paper as the same is fed to the nip formed between the roller 33 and the belt 15. Further details of the actuating mechanisms within the roller 33 for actuating the registration elements 52 and the gripper fingers 60 are unnecessary for understanding and utilizing the present invention.

Further details regarding the above described transfer roller and sheet registration and gripping actuating devices are found in U.S. Pat. No. 3,612,677. Any other similar devices may be utilized for the purposes and functions intended. As described in the foregoing cited patent, the actuation of the registration elements and gripper fingers 60 is achieved during rotation of the transfer roller under control by the energization of a solenoid. As a sheet is fed by either of the feeders 20, 30 in timed relationship with developed image on the belt 15, the leading edge is first pre-registered by the rollers 32, then are registered by the elements 52 when the same have been actuated to an outer position. As the elements 52 are retracted with the leading edge of the sheet resting upon the projection 54, the gripper fingers 60 are actuated to their retracted position upon the leading edge to grip the same against the projections 54 and both the elements 52 and the fingers 60 are further retracted so as to position these members so that they do not extend beyond the periphery of the roller 33 during rolling contact thereof with the belt 15. As will be understood from the drawing, actuation for retracting the elements 52 and fingers 60 is accomplished by rotation of the shaft 55. In one rotative direction of this shaft, the rods 56 are moved therewith to drive the elements 52 and the fingers 60 radially outward. This operation is timed just prior to the contacting of a leading edge of a sheet against the outermost top of the elements 52 to register the sheet. Continued rotation of the roller 33 to bring the sheet into the transfer nip at the transfer station 28 will coincide with the rotation of the shaft 55 to cause rotation of the shaft 55 in the other direction to move the rods 56 therewith and effect gripping of the leading edge of the sheet by the fingers 60 upon the projections 54. The fingers and elements 52 are then retracted to their most innermost position as the leading edge comes into the station 28.

As previously stated, copy sheets which have been completed as to receiving transfer images are conveyed to the fuser apparatus 36 by way of the vacuum transport 34. The transport 34 includes a split vacuum plenum 65 positioned between the runs of the belt 35 for holding a sheet bearing an unfaced toner image in an inverted orientation. The plenum 65 comprises two sections spaced horizontally to provide an open space therebetween with each section having a belt 35 associated therewith. Approximately within the plane of the transport 34, a second transport 70 is arranged having end rollers 71, 72 and a single wide perforated belt 73. The transport 70 includes a vacuum plenum 74 which is relatively narrow and is retained in the space between the two sections of the plenum 65. These plenums may be connected to a suitable vacuum source by flexible conduits. The belt 73 is driven in the opposite direction of the belts 35 for the transport 34 and is spaced therebetween. As shown in FIG. 2, the transport 70 is pivotally mounted on the axis of the end roller 71 with the outer end, or the roller 72 normally slightly elevated relative to the transport 34 so that the belt run for the belt 73 is slightly angularly related relative to the belt runs for the belts 35. The roller 72 is relatively short in order to permit its movement between the sections of the plenum 65.

Figure 5:
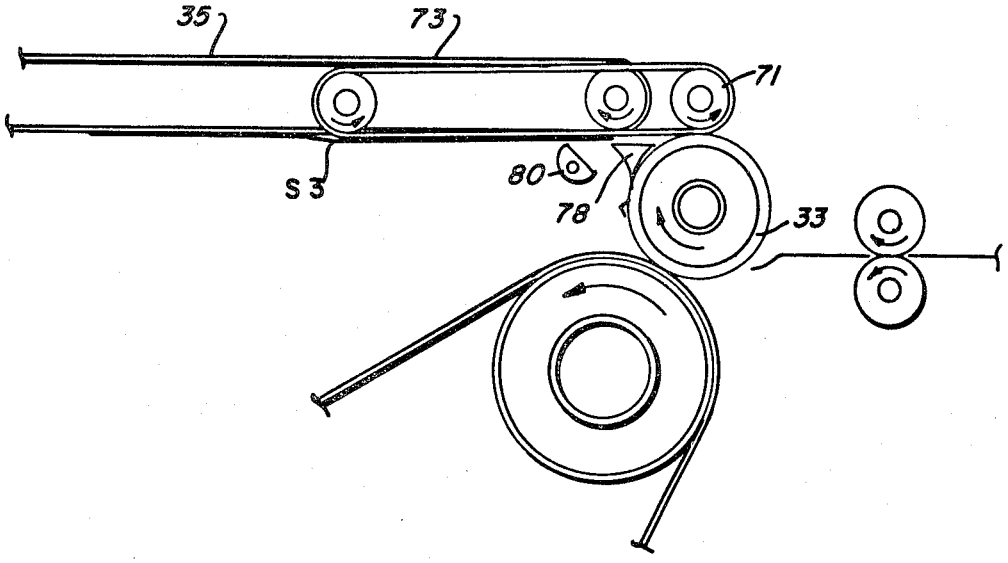
Figure 6:
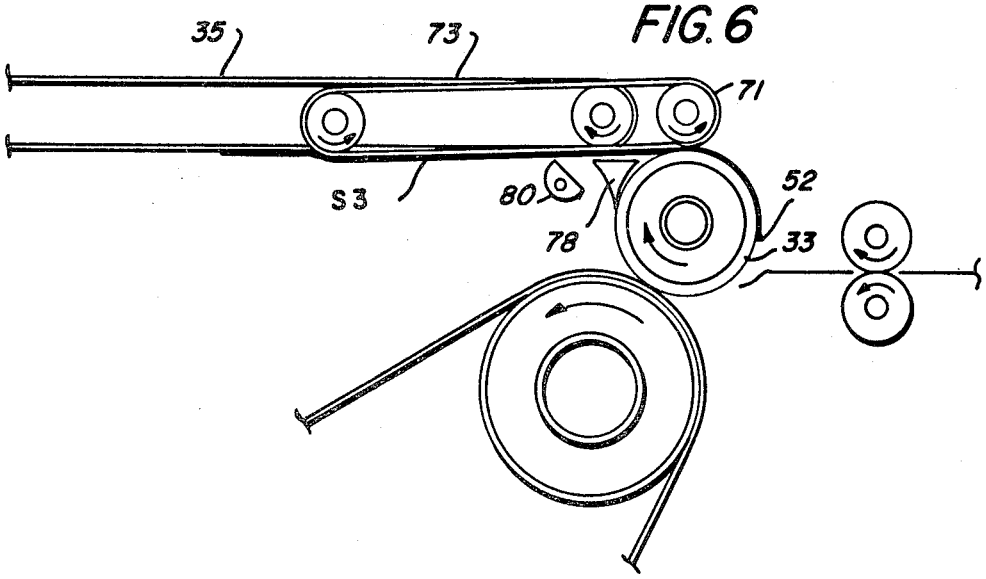

The transport 70 may be rocked slightly about the axis of the roller 71 in either direction by a suitable solenoid/return spring mechanism 75. The rocking action is very slight only to produce a few degrees of angular motion, the downward rocking action being effected by a solenoid 76 under control of the Programmer P in timed relation to copy sheets having been released from the transfer roller 33 after having a first developed image applied thereto. When the transport 70 has been rocked to its normal uppermost position under action by a spring 77 after the solenoid 76 has been deenergized, as shown in FIG. 2, it is effectively out of operation as copy sheets will be conveyed away from the transfer station by the transport 34. When the transport 70 has been actuated to its lowermost position, during duplex copying, as will be described below, the run of the belt 73 will project below the run of the belts 35, as shown in FIGS. 5 and 6, so as to drive a sheet in the opposite direction to that provided by the belts 35 and to convey the sheet back into engagement with the transfer roller to effect a second image transfer on the back side of the sheet. After this second transfer, the transport 70 is rocked to its normal upper or inoperative position to permit the now duplex copy sheet to proceed to the fuser apparatus 36.

In operation, as shown in FIG. 2, which is indicative of the simplex copying mode, a first sheet $S_1$ is leaving the transfer station nip 28 after having transferred thereto a developed image from the photoreceptor belt 15. A guide/stripout device 78 is arranged to strip the sheet off the transfer roller and to direct the same upon the lower run of the transport 34 in an inverted position. In this mode of operation, the transport 70 is held in its uppermost rocked position. A second sheet $S_2$ closely follows sheet $S_1$, having been preregistered by the rollers 32 and now being registered by the elements 52 and gripped to the transfer roller 28 by the fingers 60. Since the rollers 32 are driven at a higher velocity than the roller 28, a slight buckle forms in the sheet $S_2$ to aid in final registration. Successive copy sheets are continuously fed and processed in this manner until the preset reproduction run has been completed. Copy sheets are conveyed by the transport 34 to the fuser apparatus 36 and finally to the output tray 37.

Figure 3:
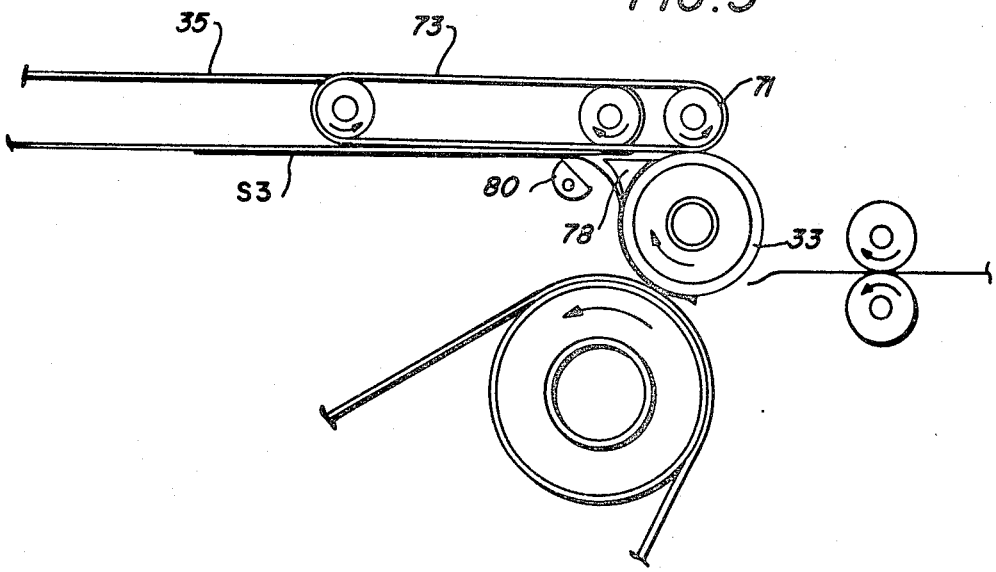

In the duplex mode of operation as shown in FIG. 3, the sheet $S_3$ is leaving the transfer station nip after having a developed image transferred thereto from the photoreceptor belt 15 in the same manner as sheet $S_1$ in FIG. 2. However, since the duplex mode of operation has been programmed, a pre-fuser device 80 would have been energized, and as the sheet $S_3$ leaves the transfer nip with the transferred powder image on the lower side thereof, the toner image will be reduced to a crusty state so that the toner particles will not adhere to the surface of the biased transfer roller 33 with which it will subsequently contact. In addition, when the duplex mode of operation has been preset, in timed sequence, the programmer P will effectively inhibit alternate sheet feeds so that a close-by second sheet as sheet $S_2$ was in FIG. 2 will not be presented by the transport 31. In this mode of operation, the programmer P will also correspondingly inhibit alternate feeding and exposing of document sheets.

Figure 4:
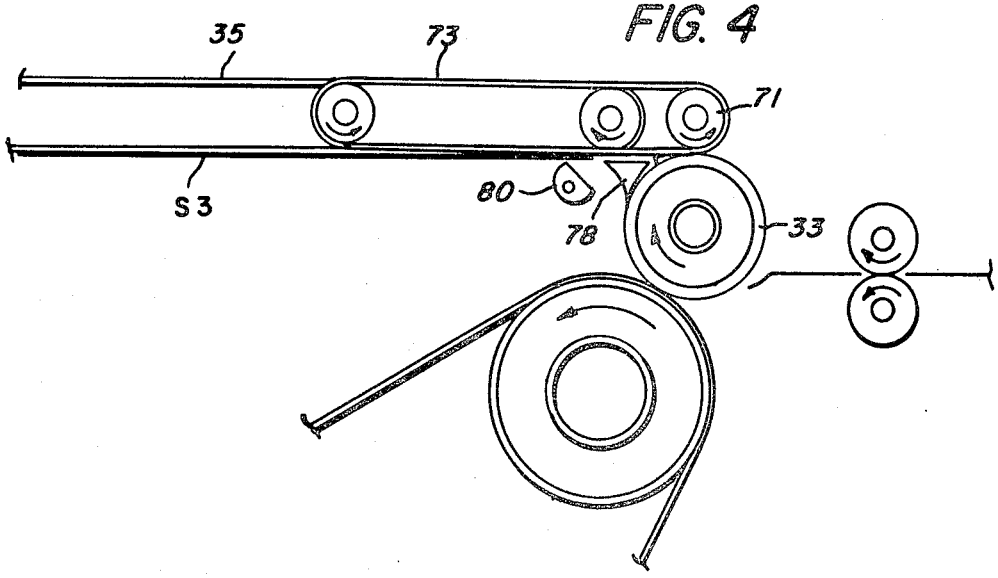

When the sheet $S_3$ has been fully applied to the belt 35 as shown in FIG. 4, the solenoid 76 will be energized whereby the transport assembly 70 will be rocked about the pivot of the roller 71 in timed sequence so that the belt 73 projects below the surface of the belts 35 thereby becoming applied to and active upon the sheet $S_3$. Since the belt 73 is travelling in the opposite direction from that of the belts 35, the sheet $S_3$ will be conveyed back to the bias transfer roller and into registration contact with the registration elements 52. When the leading edge of the trailing edge of the sheet $S_3$ has been so registered and the fingers 60 grip the same, the sheet will be reconveyed back into the transfer nip to receive a second toner image on the side of the sheet opposite that upon which the first image was applied. The bias transfer roller 28, as shown in FIG. 6, will bring the sheet $S_3$ back into the transfer station. During this operative step, the solenoid 76 will be energized to permit the spring 77 to return the transport 70 to its inoperative condition. Conveyance of the sheet will then be returned to the transport 34 which is now in condition for removing the sheet out to the output tray 37. It will be understood that other alternatives for the function of the duplex transport 70 may be employed. For example, this transport may be eliminated and the transport 34 arranged to be reversed at the time, during duplex operation, when a sheet is fully on the belts 35 and are to be returned to the transfer station to receive a second toner image.

The timing of the foregoing events is such that the productivity rate in the duplex mode is one-half that of the simplex mode so that in the duplex mode, alternate machine pitches will not be utilized to provide paper feed and illumination of a document sheet. The total productivity of the machine, however, remains the same in that the total number of images produced on paper will remain the same.

It will be appreciated from the foregoing description that the present invention involves an arrangement for duplexing copy sheets without the need for auxiliary trays and accompanying feed systems, or other complicated mechanisms which heretofore have been utilized for transporting and collecting sheets having their first image applied on one side so that the other side may be brought into position for receiving second images.

While the invention has been described with reference to the structure disclosed, it is not confined to the details set forth but is intended to cover such modifications or changes as may come within the scope of the following claims.

I claim:

1. Copy sheet handling system for use to produce duplex copy sheets in a copying machine having copy sheet supply and feed means, a transfer station at which a developed toner image on a photoreceptor is transferred to a copy sheet, and a fusing apparatus for fixing toner images on copy sheets, the improvement comprising:

a transfer roller positioned at the transfer station adjacent the photoreceptor and arranged to direct a copy sheet received from the sheet feed means to the photoreceptor with the sheet therebetween to receive a toner image thereon, said roller including means for holding the copy sheet thereon for directing the same through the transfer station, and transport means positioned to receive the copy sheet after the same has received an image on one side thereof and to convey the sheet from said roller, and selectively to direct the sheet to the fusing apparatus for fixing the image and out of the copying means, or before the sheet is directed to the fusing apparatus to return the sheet to said roller to be held thereon by said holding means for a second pass to the transfer station to receive a second image on the second side thereof.

2. The copy sheet handling system in claim 1 wherein said holding means includes a gripper mechanism for gripping the leading edge of a sheet as the same is directed to the transfer station, and for gripping the trailing edge of the sheet when the same is returned to said roller.

3. The copy sheet handling system in claim 1 wherein said holding means includes means for registering the sheet prior to the sheet being moved to receive an image on either side thereof.

4. Copy sheet handling system for use to produce duplex copy sheets in a copying machine having copy sheet supply and feed means, a transfer station at which a developed toner image on a photoreceptor is transferred to a copy sheet, and a fusing apparatus for fixing toner images on copy sheets, the improvement comprising:

a transfer roller positioned at the transfer station adjacent the photoreceptor and arranged to direct a copy sheet received from the sheet feed means to the photoreceptor with the sheet therebetween to receive a toner image thereon, said roller including means for holding the copy sheet thereon for directing the same through the transfer station, and transport means positioned to receive the copy sheet after the same has received an image on one side thereof and to convey the sheet from said roller, and before the sheet is directed to the fusing apparatus to return the sheet to said roller in an inverted orientation for a second pass to the transfer station to receive a second image on the second side thereof.

5. Copy sheet handling system for use to produce duplex copy sheets in a copying machine having copy sheet supply and feed means, a transfer station at which a developed toner image on a photoreceptor is transferred to a copy sheet, and a fusing apparatus for fixing toner images on copy sheets, the improvement comprising:

a transfer roller positioned at the transfer station adjacent the photoreceptor and arranged to direct a copy sheet received from the sheet feed means to the photoreceptor with the sheet therebetween to receive a toner image thereon, means positioned to receive and remove the copy sheet from said transfer roller after the same has received an image on one side thereof, and before the sheet is directed to the fusing apparatus to reapply the sheet to said roller in an inverted orientation and to effect a second pass to the transfer station to receive a second image on the second side thereof, and means for pre-fusing the sheet before the same is reapplied to the roller.

* * * * *